US009281110B2

(12) United States Patent
Wu et al.

(10) Patent No.: US 9,281,110 B2
(45) Date of Patent: Mar. 8, 2016

(54) EXTERNAL-MAGNET-TYPE MAGNETIC CIRCUIT

(71) Applicant: MERRY ELECTRONICS (SUZHOU) CO., LTD., Suzhou, Jiangsu Province (CN)

(72) Inventors: Chien Ju Wu, Taichung (TW); Wen Hong Wang, Taichung (TW); Chun Pin Chen, Taichung (TW)

(73) Assignee: MERRY ELECTRONICS (SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 14/453,680

(22) Filed: Aug. 7, 2014

(65) Prior Publication Data

US 2015/0213932 A1 Jul. 30, 2015

(30) Foreign Application Priority Data

Jan. 29, 2014 (TW) ..... 103103573 A

(51) Int. Cl.
*H01F 7/02* (2006.01)

(52) U.S. Cl.
CPC ..... *H01F 7/0289* (2013.01)

(58) Field of Classification Search
CPC ..... H01F 7/00; H01F 7/021
USPC ..... 335/302, 306
See application file for complete search history.

(56) References Cited

U.S. PATENT DOCUMENTS

| | | | | | |
|---|---|---|---|---|---|
| 2,714,134 | A * | 7/1955 | Touger et al. | ..... | 381/345 |
| 3,593,239 | A * | 7/1971 | Hofman | ..... | 335/231 |
| 4,580,119 | A * | 4/1986 | Iijima et al. | ..... | 335/296 |
| 8,344,843 | B2 * | 1/2013 | Larsen | ..... | 336/221 |
| 8,428,295 | B2 * | 4/2013 | Humphreys | ..... | 381/400 |
| 2008/0180201 | A1 * | 7/2008 | Sato | ..... | 335/278 |

FOREIGN PATENT DOCUMENTS

| | | | | | |
|---|---|---|---|---|---|
| DE | 102007002065 | A1 * | 7/2008 | | |
| GB | 1149060 | A * | 4/1969 | ..... | H01F 7/021 |

* cited by examiner

*Primary Examiner* — Mohamad Musleh
(74) *Attorney, Agent, or Firm* — Bacon & Thomas, PLLC

(57) ABSTRACT

An external-magnet-type magnetic circuit includes an iron core and at least one composite magnet coaxially mounted around the iron core. The composite magnet has two magnetic poles with field directions thereof substantially perpendicular to each other, wherein one of the magnetic poles has the field direction thereof pointing to the iron core, and a magnetism-guiding plate being deposited on the other magnetic pole of the composite magnet and being separated from the iron core by a magnetic gap. Thereby, the composite magnet provides high magnetic flux density in relatively small volume, without the additional use of any magnetism-guiding yokes, and thus is particularly suitable for small-size amplifiers where it helps to improve acoustic sensitivity and acoustic output performance.

7 Claims, 3 Drawing Sheets

EXTERNAL-MAGNET-TYPE MAGNETIC CIRCUIT

BACKGROUND OF THE INVENTION

1. Technical Field

The present invention relates to acoustic amplifiers, and more particularly to an external-magnet-type magnetic circuit that uses a composite magnet with inner diameter alignment, and provides adequate magnetic flux density in limited volume.

2. Description of Related Art

According to ways of energy conversion, amplifiers are generally classified into the dynamic type, the electromagnetic type and the electric condenser type. Therein a dynamic-type amplifier, also known as a moving-coil-type amplifier, mainly works using the electromagnetic induction generated between its internal magnetic circuit and voice coil to make a diaphragm vibrate. The magnet in the magnetic circuit plays an important role as it serves to provide a uniform and stable magnetic field for the vibration of the voice coil.

Furthermore, magnetic circuits in amplifiers can be divided into internal magnetic circuits and external-magnet-type magnetic circuits according to where the magnet is located in the magnetic circuit. Due to difficulty in magnet manufacturing, small-size amplifiers typically adopt an external-magnet-type magnetic circuit. FIG. 1 depicts an external-magnet-type magnetic circuit 1, which comprises a magnetism-guiding yoke 2. The magnetism-guiding yoke 2 has a plate portion 2*a* and a core portion 2*b* raised from the inner portion of the top surface of the plate portion 2*a*, so that it has an L-like sectional shape. A permanent magnet 3 is deposited on the outer portion of the top surface of the plate portion 2*a*. A magnetism-guiding plate 4 is installed on the top surface of the permanent magnet 3 and is separated from the core portion 2*b* by a magnetic gap 5. Therein, the two magnetic poles of the permanent magnet 3 are at two ends and face the plate portion 2*a* of the magnetism-guiding yoke 2 and the magnetism-guiding plate 4, respectively, thereby guiding the magnetic lines of force into the magnetic gap 5 to form a uniform magnetic field. For maintaining adequate magnetic flux density, the permanent magnet 3 would have to take a certain space and this is against to the trend of miniaturization. In addition, magnetic flux leakage tends to happen in such a conventional external-magnet-type magnetic circuit. Hence, the prior-art structure needs to be improved in terms of both size and capability of allowing good acoustic performance of amplifiers using it.

SUMMARY OF THE INVENTION

In view of this, one primary objective of the present invention is to provide an external-magnet-type magnetic circuit, which uses a magnet with specific magnetic alignment to increase magnetic flux density to a desired extent, so as to improve acoustic sensitivity.

Another primary objective of the present invention is to provide an external-magnet-type magnetic circuit, which is favorable to miniaturization of amplifiers.

For accomplishing the foregoing objectives, the disclosed external-magnet-type magnetic circuit comprises: an iron core; at least one composite magnet coaxially mounted around the iron core, wherein two magnetic poles of the composite magnet have their field directions substantially perpendicular to each other, and one of the magnetic poles has its field direction pointing to iron core; and a magnetism-guiding plate deposited on the other magnetic pole of the composite magnet, in which the magnetism-guiding plate and the iron core are separated by a magnetic gap.

Therein, the magnetic poles of the composite magnet have been previously magnetically aligned and have their directions substantially perpendicular to each other so as to prevent magnetic flux leakage. In addition, the iron core when working with the magnetism-guiding plate can form a uniform magnetic field in the magnetic gap so as to provide a voice coil with adequate magnetic flux density. Moreover, as compared to the conventional external-magnet-type magnetic circuits, the disclosed structure eliminates the need for a plate portion that is used in the prior art for supporting the magnetism-guiding yoke, and is therefore favorable to miniaturization of amplifiers.

Preferably, the composite magnet is an anisotropic bonded magnet or an anisotropic pressed powder magnet.

Preferably, the iron core has a columnar shape and the composite magnet has an annular body. The body has a stepped inner structure that includes a small-diameter portion and a large-diameter portion. One of the magnetic poles of the composite magnet is on an inner lateral surface of the small-diameter portion, while the other of the magnetic poles of the composite magnet is on an outer end surface of the large-diameter portion where the magnetically conducting plate is deposited.

DETAILED DESCRIPTION OF THE INVENTION

Figure 2:
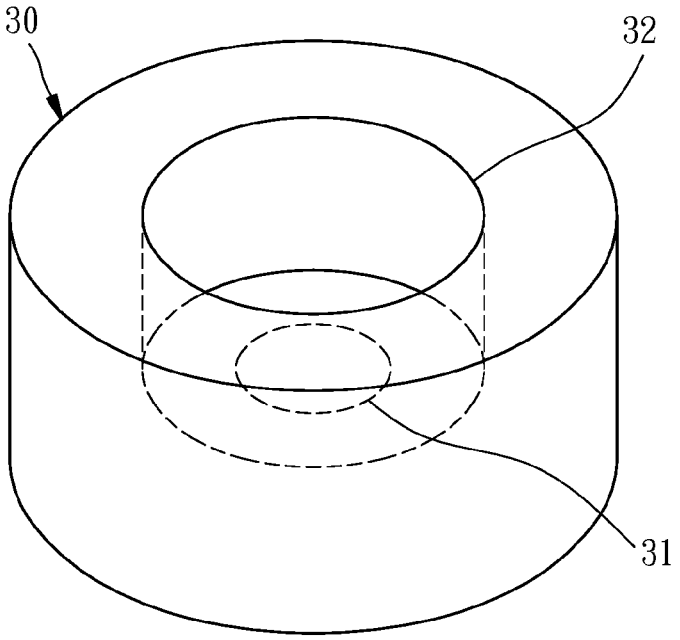
FIG. 2 is a perspective view of a preferred embodiment of the present invention.
Figure 3:
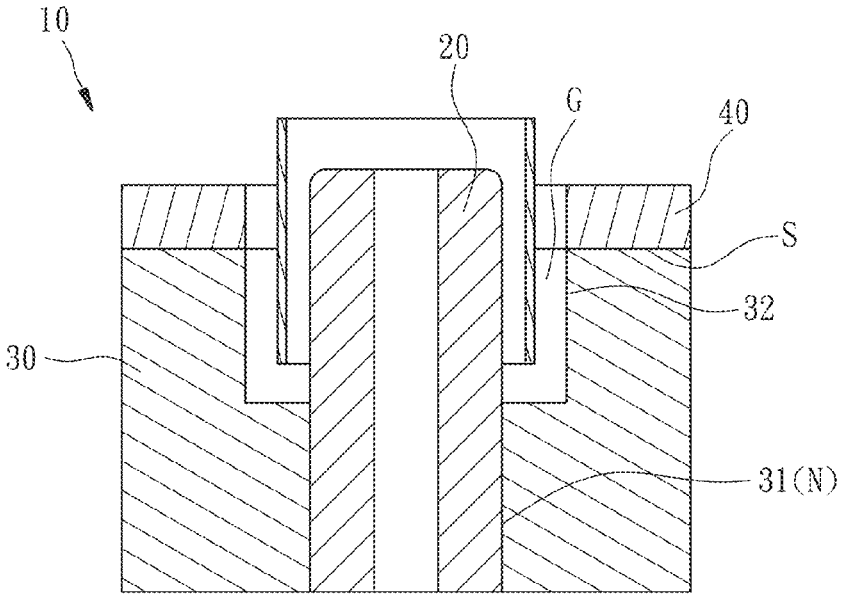
FIG. 3 is cross-sectional view of the preferred embodiment of the present invention.

For better illustrating the features of the present invention, a preferred embodiment of the present invention is described herein as an external-magnet-type magnetic circuit 10, as shown in FIG. 2 and FIG. 3. The external-magnet-type magnetic circuit 10 has a columnar iron core 20, an annular composite magnet 30 that is coaxially mounted around the iron core 20, and a magnetism-guiding plate 40 deposited on the top of the composite magnet 30. Therein, the magnetism-guiding plate 40 and the iron core 20 are separated by a magnetic gap G.

Referring to FIG. 3, the composite magnet 30 has the inner side of its body formed as a stepped structure that includes a small-diameter portion 31 and a large-diameter portion 32. The small-diameter portion 31 embraces the iron core 20, and the magnetism-guiding plate 40 is deposited on the outer end surface of the large-diameter portion 32. In addition, the composite magnet 30 is an anisotropic bonded magnet that has been previously magnetically aligned (i.e. having its magnetization oriented using a magnetic field or mechanically). Herein, an anisotropic bonded magnet refers to a permanent magnetic material that is made by well mixing permanent rare earth magnetic powder, such as NeFeB or SmCo or AlNiCo, with resin, plastic or binding agent for low melting-point alloy, and compressing, extruding or injecting the mixture. Therefore, in the present invention, the two magnetic poles of the composite magnet 30 are with their field directions substantially perpendicular to each other. One of the magnetic pole (namely the magnetic north pole in the present embodiment) is on the inner lateral surface of the small-diameter portion 31 with its field direction pointing to the iron core 20, while the other magnetic pole (namely the magnetic south pole in the present embodiment) is on the outer end surface of the large-diameter portion 32 with its field direction pointing to the magnetism-guiding plate 40, forming a distribution of magnetic lines of force shown as FIG. 5.

Figure 1:
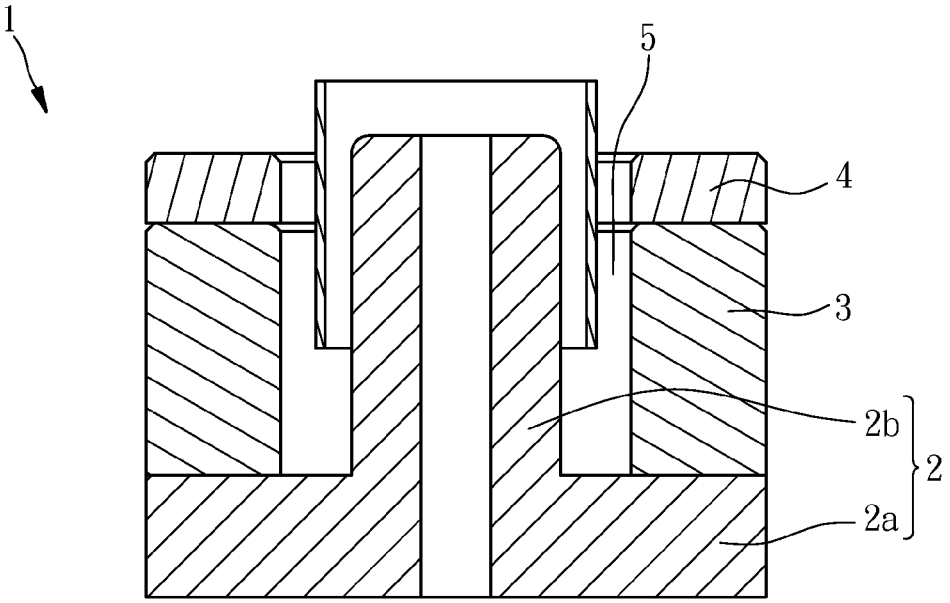
FIG. 1 PRIOR ART
FIG. 1 is a cross-sectional view of a conventional external-magnet-type magnetic circuit.
Figure 4:
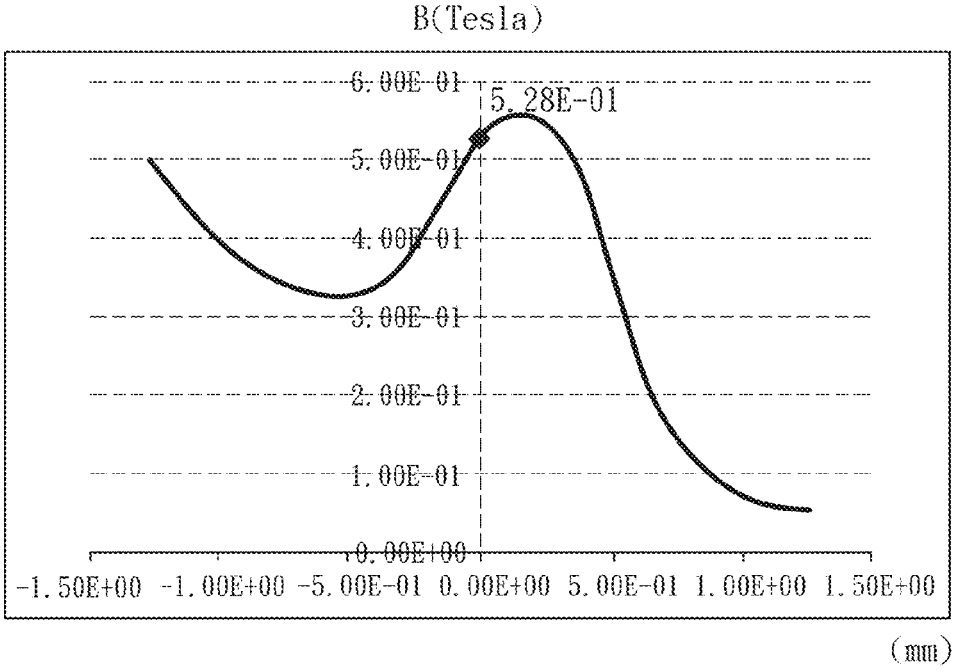
FIG. 4 is a diagram of the magnetic flux density measured in the magnetic gap of the preferred embodiment of the present invention.
Figure 5:
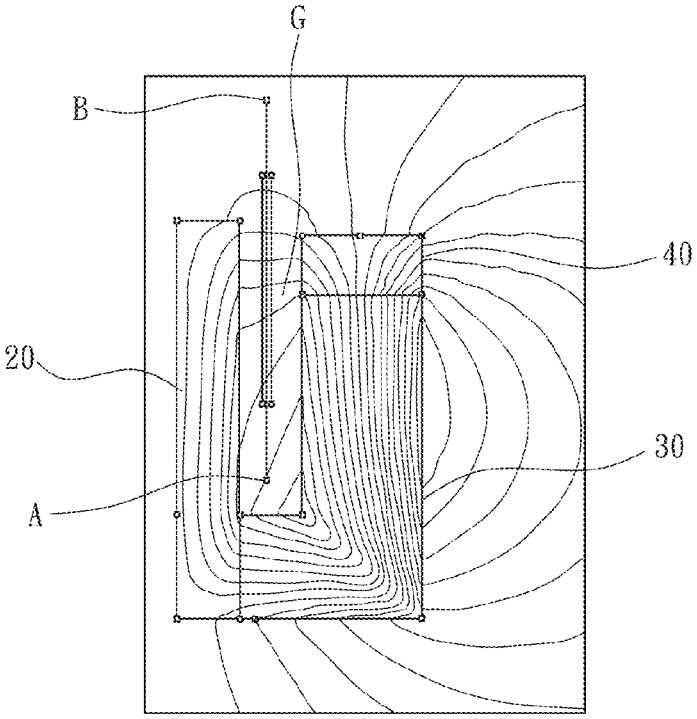
FIG. 5 is a distribution chart of the magnetic lines of force of the preferred embodiment of the present invention.
Figure 6:
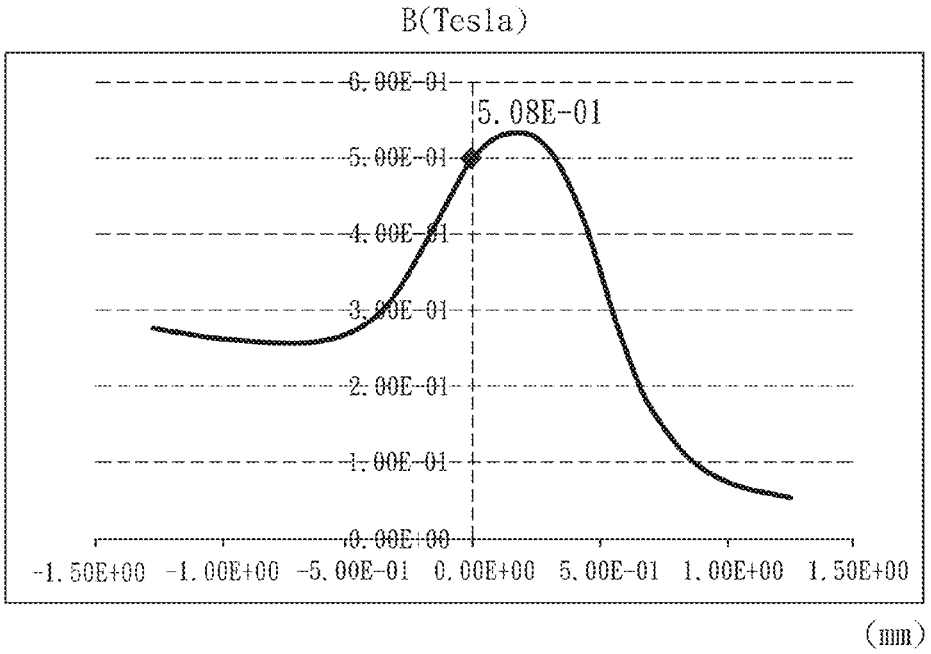
FIG. 6 is a diagram of the magnetic flux density measured at the magnetic gap of the conventional external-magnet-type magnetic circuit of FIG. 1.

By using NeFeB permanent magnetic powder to produce the composite magnet 30 of the discussed embodiment, and measuring the magnetic flux density from Point A to Point B in the magnetic gap G of FIG. 5, it is learned that the magnetic flux density at the center of the magnetic gap G reaches 0.528 B (Tesla), with a distribution as shown in FIG. 4. When the same measurement is applied to the conventional external-magnet-type magnetic circuit of FIG. 1, the obtained distribution of the magnetic flux density is as that shown in FIG. 6, with the magnetic flux density at the center of the magnetic gap only 0.508 B (Tesla). Also, be comparing FIG. 4 and FIG. 6, it is clear that the maximum and the average of the magnetic flux density of the present embodiment are both greater than those of the conventional circuit. This evidences that the present invention provides higher magnetic flux density in a given spacial limitation.

By providing higher magnetic flux density, the disclosed external-magnet-type magnetic circuit 10 helps to improve acoustic sensitivity of amplifiers using it. Moreover, by shaping the composite magnet 30 as an annular structure with stepped and magnetically aligned inner surface, the present invention eliminates the need of the magnetism-guiding yoke below the magnet, thereby preventing magnetic flux leakage and being favorable to miniaturization of amplifiers.

It is to be noted that the iron core as described is substantially non-magnetic, and the composite magnet 30 may be alternatively made through pressing consolidation of permanent magnetic powder as a pressed powder magnet, provided it has been previously magnetically aligned. Additionally, the amount and the shape of the composite magnet 30 are not limited to those recited in the embodiment. In other embodiments, for example, two lengthwise composite magnets each having an L-like sectional shape may be provided at two sides of the iron core to form a magnetic circuit equivalent to that shown in FIG. 2, and the iron core may be magnetic (namely a magnet core), as long as the magnetic lines of force can be proper guided.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An external-magnet-type magnetic circuit, comprising:

an iron core;

at least one composite magnet, being coaxially mounted around the iron core and having two magnetic poles with field directions thereof substantially perpendicular to each other, wherein one of the magnetic pole has the field direction thereof pointing to the iron core; and a magnetism-guiding plate, being deposited on the other of the magnetic poles of the composite magnet and being separated from the iron core by a magnetic gap that is coaxially arranged around the iron core;

wherein the composite magnet has an annular body with a stepped inner structure that includes a small-diameter portion and a large-diameter portion; the large-diameter portion of the composite magnet is separated from the iron core by the magnetic gap.

2. The external-magnet-type magnetic circuit of claim 1, wherein the composite magnet is an anisotropic bonded magnet or an anisotropic pressed powder magnet.

3. The external-magnet-type magnetic circuit of claim 1, wherein the iron core has a columnar shape.

4. The external-magnet-type magnetic circuit of claim 1, wherein one of the magnetic poles of the composite magnet is on an inner lateral surface of the small-diameter portion, while the other of the magnetic poles of the composite magnet is on an outer end surface of the large-diameter portion where the magnetism-guiding plate is deposited.

5. The external-magnet-type magnetic circuit of claim 1, wherein the at least one composite magnet is in an amount of one.

6. The external-magnet-type magnetic circuit of claim 1, wherein the at least one composite magnet is in an amount of two, and each of the composite magnets has an L-like sectional shape.

7. The external-magnet-type magnetic circuit of claim 1, wherein the iron core is substantially non-magnetic.

* * * * *